US005843273A

United States Patent [19]

Geiser

[11] Patent Number: 5,843,273

[45] Date of Patent: Dec. 1, 1998

[54] DEVICE FOR APPLYING AN ADHESIVE TO AN OBJECT CONVEYED PAST IT

[75] Inventor: Peter Geiser, Matzingen, Switzerland

[73] Assignee: Grapha-Holding AG, Hergiswil, Switzerland

[21] Appl. No.: 750,787

[22] PCT Filed: Apr. 3, 1996

[86] PCT No.: PCT/CH96/00118

§ 371 Date: Dec. 10, 1996

§ 102(e) Date: Dec. 10, 1996

[87] PCT Pub. No.: WO96/32292

PCT Pub. Date: Oct. 17, 1996

[30] Foreign Application Priority Data

Apr. 11, 1995 [CH] Switzerland ..... 1059/95

[51] Int. Cl.[6] ..... B05C 1/00

[52] U.S. Cl. ..... 156/578; 118/244; 118/258

[58] Field of Search ..... 156/578; 118/258, 118/259, 261, 244

[56] References Cited

U.S. PATENT DOCUMENTS 4,117,800 10/1978 Maus et al. ..... 118/261 X
4,964,367 10/1990 Belter ..... 118/258 X

FOREIGN PATENT DOCUMENTS 0587026 3/1994 European Pat. Off. .
3438258 5/1985 Germany .

*Primary Examiner*—James Engel
*Attorney, Agent, or Firm*—Spencer & Frank

[57] ABSTRACT

A device for applying a liquid adhesive to an object conveyed past the object includes a trough for containing the liquid adhesive and an electric motor. The motor includes a stator held by the trough and a rotor arranged at least partially in the trough and operatively associated with the stator for rotating when an electric current is applied to the stator. The rotor includes an application roller for applying liquid adhesive contained in the trough to the object conveyed past the device.

10 Claims, 4 Drawing Sheets

DEVICE FOR APPLYING AN ADHESIVE TO AN OBJECT CONVEYED PAST IT

BACKGROUND OF THE INVENTION

The invention concerns a device for applying a liquid adhesive to an object conveyed past it, consisting of an adhesive-containing trough, on which an application roller that partially submerges into the adhesive is installed such that it rotates around a horizontal axis.

Such devices are known, among other things, for the labeling of objects or for the adhesive-bonding technique in the manufacture of adhesive-bonded book blocks or books, booklets, etc.

The drive for the application roller or rollers is by means of a shaft that is fitted through the walls of the adhesive trough, on which the application roller runs on bearings. The adhesives, which in part are chemically aggressive, along with the alternate warming and cooling of the adhesives stress the bearing seals for the application roller that are installed below the surface of the adhesive and result in a leaky trough after a certain period of use.

From European Patent Document EP-A-0 587 026, we are familiar with a gluing mechanism for adhesive-bonding machines, for which one half of the magnetic coupling consisting of two disks is located on the drive shaft outside of the gluing trough, while the other half is located on the application roller that is positioned inside the gluing mechanism. Both magnetic coupling halves are positioned coaxially on both sides of a trough wall and face each other. The frontal surfaces of the magnetic coupling halves that face each other are magnetized.

SUMMARY OF THE INVENTION

It is thus the object of the invention to create a device of the aforementioned type, for which the leakiness of the trough is corrected and the relating maintenance is not necessary.

The solution according to the invention is that the trough holds the stator for the application roller that is designed as the rotor of an electric motor.

Alternating current or direct current motors with a magnetic rotor, electric motors with short-circuit rotor, motors with eddy current rotors, stepping motors, magnetic resistance motors or other motors that generate a rotational field can be used as electric motors.

Either internal or external rotor type motors are suitable for the device according to the invention.

The symmetrical design of an electric motor prevents forces that are effective on a single side only.

In the following, the invention is explained in more detail with the aid of various embodiments and by referring to the drawing, to which reference is made for all details not mentioned expressly in the description.

DETAILED DESCRIPTION OF THE INVENTION

Figure 1:
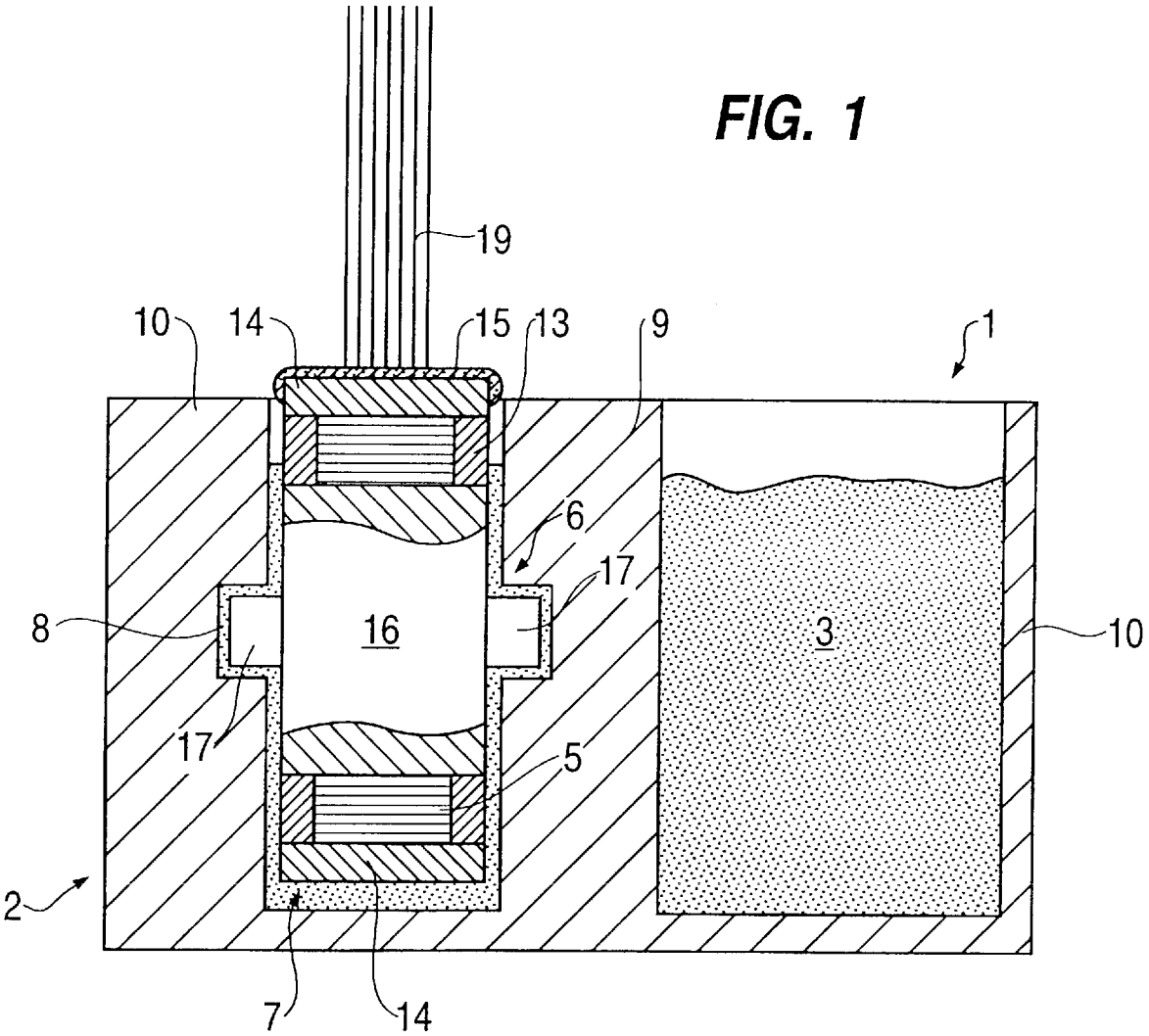
FIG. 1 is a cross section through the device according to line I÷I in FIG. 2.
Figure 2:
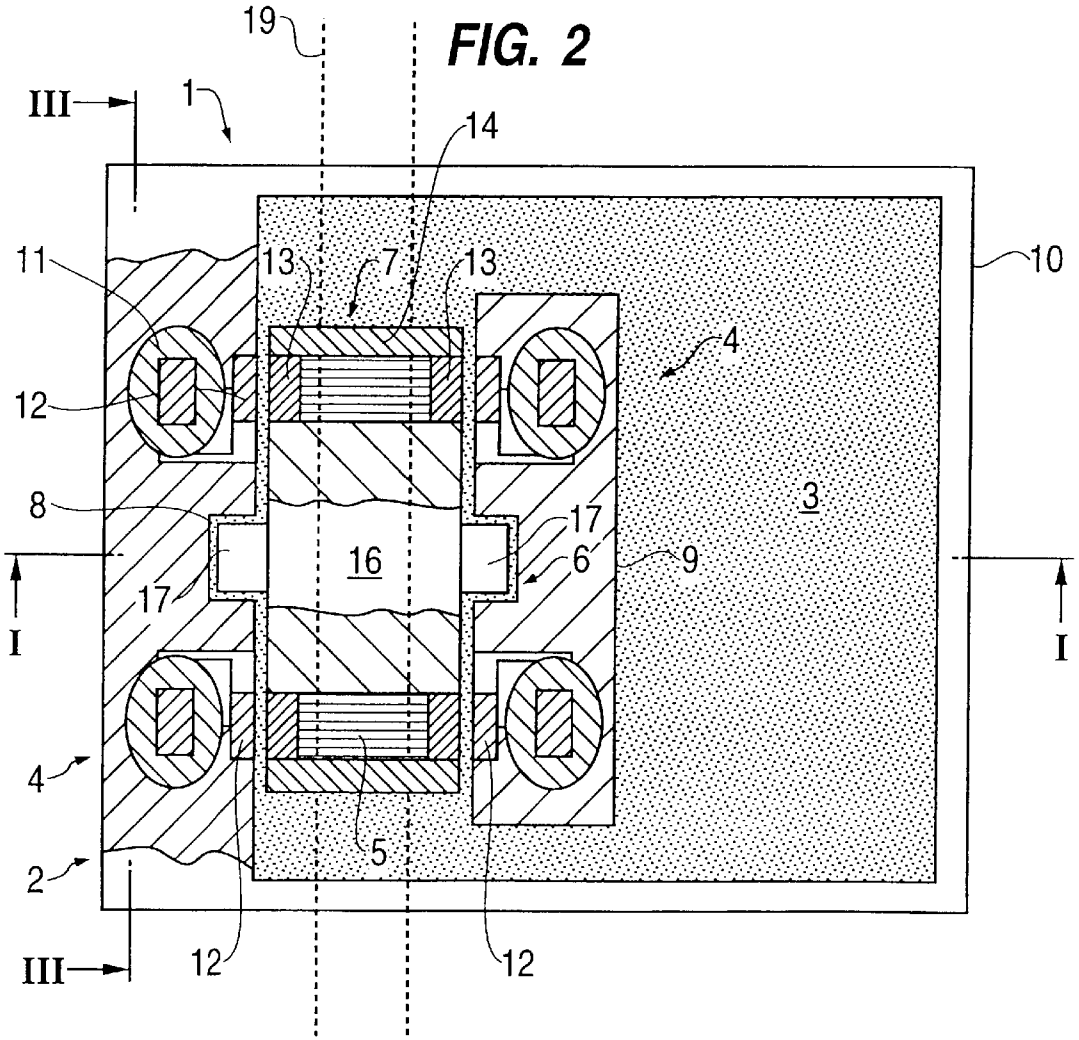
FIG. 2 is a cut through the device at Line II÷II in FIG. 3.

FIGS. 1 and 2 show a device 1 for applying a liquid adhesive 3 contained in a trough 2. Boreholes 8 for supporting an application roller 7 are provided in the trough 2, which holds a stator 4 of the application roller 7 that is designed as a rotor 16 of an electric motor 6, wherein the exemplary embodiment shown has an additional bearing block 9 for a dual support of the application roller 7, which could also be positioned cantilevered in a wall 10 of the trough 2. The stator 4 of the electric motor 6 is provided on both sides of the rotor 16 and is mounted on the one hand in the wall 10 of the trough 2 and, on the other hand, in the rib-like bearing block 9.

Figure 3:
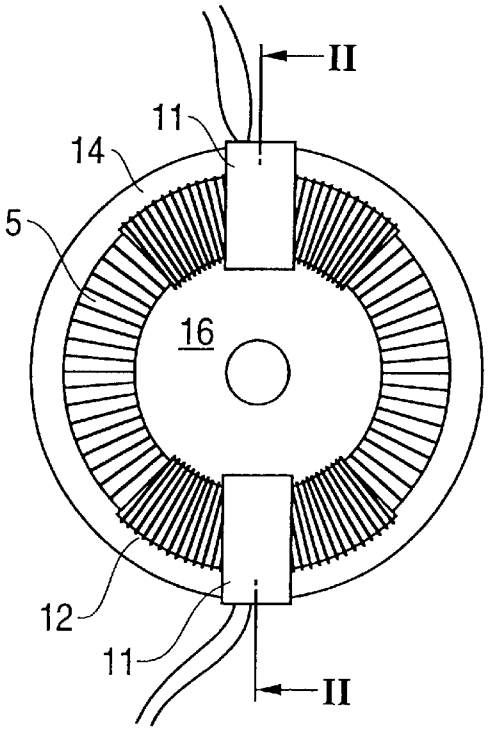
FIG. 3 is a cut through the device according at line III÷III in FIG. 2.

The stator 4 that generates a rotating field also has an iron core 12 surrounded by an electric field winding 11—see FIG. 3—that consists of two ring-shaped segments and is arranged stationary next to the rotor 16. Through the magnetic rotating field generated by the stator 4 under the effects of electric energy, the rotor 16 starts rotating as a result of the permanent magnets 5, arranged along its circumference. A ring-shaped layer 14, made of a non-magnetizable material, is arranged around the circumference of rotor 16 or a ring is attached, which layer has an adhesive film 15 on the top that is transferred at least in part to the spine of a clamped-in book block 19, which rolls off on it. Furthermore, the application roller 7 is composed of a non-magnetizable rotor 16 with journals 17 that extend out to the side.

To the side of the permanent magnets 5, the rotor 16 has one each guide ring 13 for the magnetic flow under the permanent magnets 5.

Figure 4:
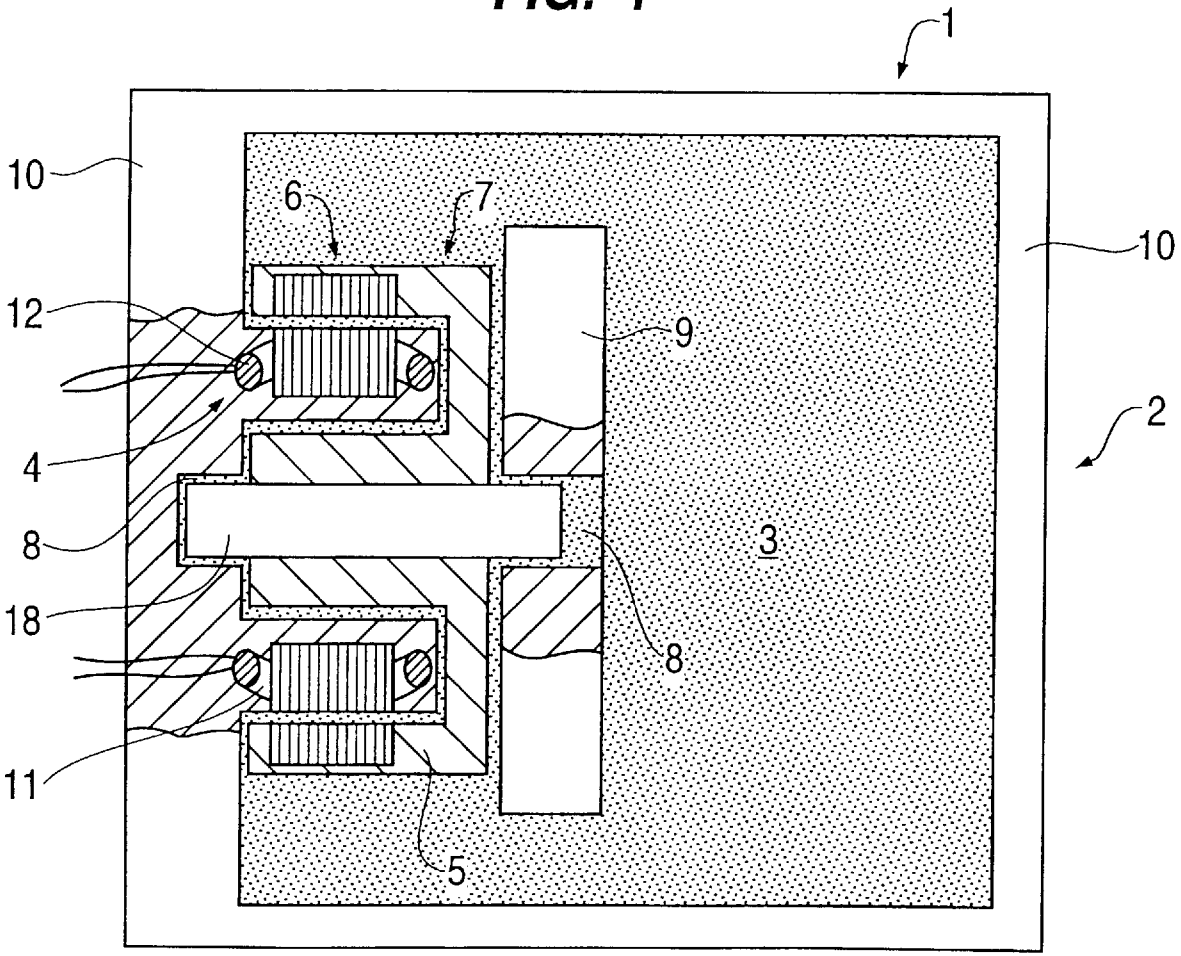
FIG. 4 is a view from above of an alternate embodiment of the device.

FIG. 4 illustrates an electric motor 6, designed as external rotor type motor, for which the stator 4 that generates a rotational field is ring-shaped and is arranged on the wall 10 of the trough 2 such that it has a circumferential effect. The wheel-shaped rotor 16 with permanent magnets surrounds the stator 4 and is connected by means of a non-magnetizable disk 20 on the side with a shaft 18, which is on the one hand mounted on the wall 10 and on the other hand is positioned in bearing block 9 of the trough 2.

Figure 5:
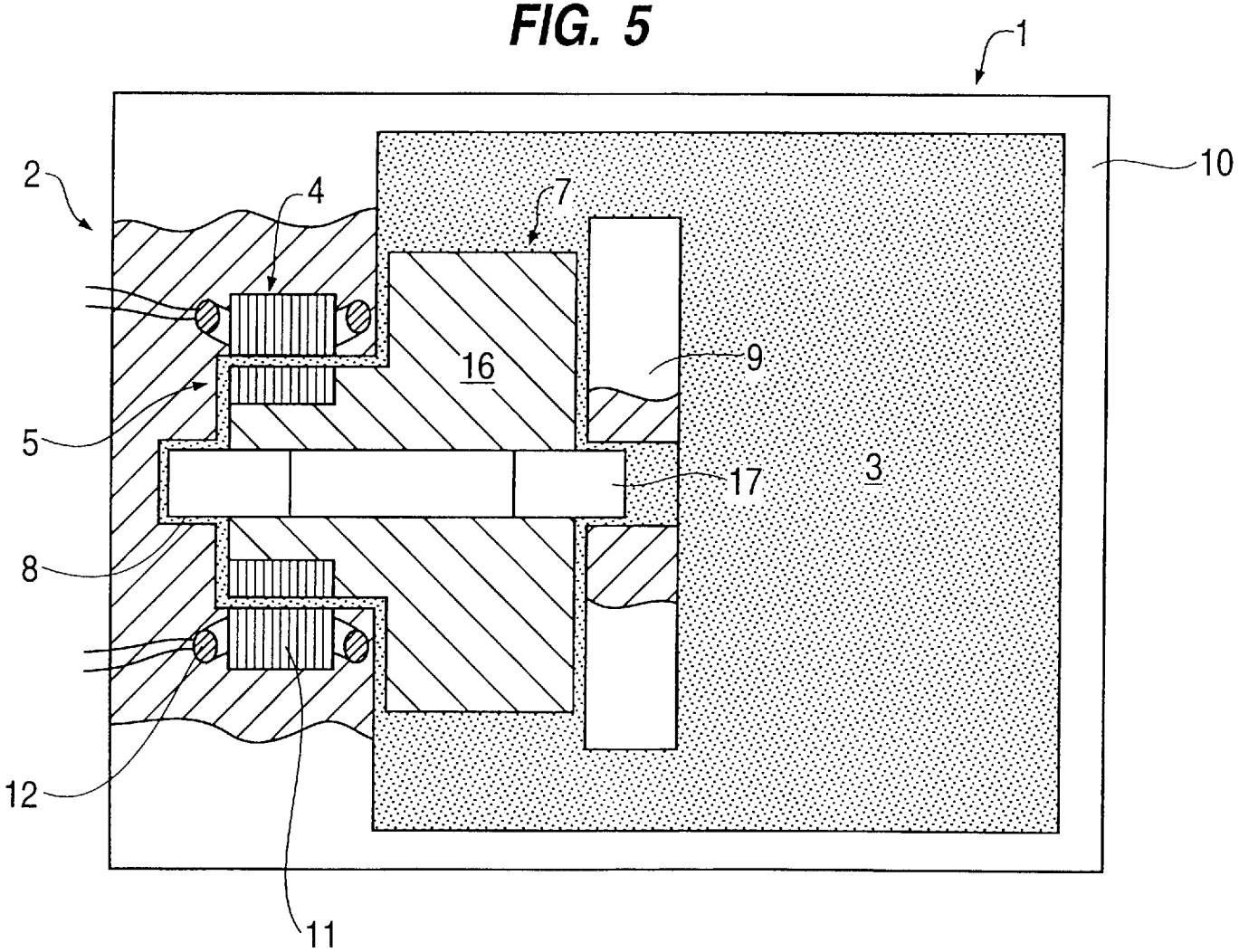
FIG. 5 is a view from above of another alternate embodiment of the device.

FIG. 5 shows an internal rotating type motor in an arrangement that is identical to the one in FIG. 4.

I claim:

1. A device for applying a liquid adhesive to an object conveyed past the device, comprising:

a trough for containing liquid adhesive; and an electric motor including:

a stator held by the trough; and a rotor arranged at least partially in the trough and operatively associated with the stator for rotating when an electric current is applied to the stator, the rotor including an application roller for applying liquid adhesive contained in the trough to the object conveyed past the device.

2. The device according to claim 1, wherein the electric motor comprises one of an internal and external rotor motor.

3. The device according to claim 1, wherein the rotor includes permanent magnets and the stator includes a field winding.

4. The device according to claim 1, wherein the trough includes a wall and the stator is arranged in the wall of the trough.

5. The device according to claim 4, wherein the wall has a bore and the rotor has one side positioned in the bore.

6. The device according to claim 4, further including a bearing block inside the trough, wherein the rotor is additionally positioned on its side opposite the wall of the trough on the bearing block inside the trough.

7. The device according to claim 5, wherein the application roller is disposed on a side of the rotor opposite the bore.

8. The device according to claim 3, wherein the rotor has a circumference that constitutes the application roller and has a frontal side on which the permanent magnets are disposed.

9. The device according to claim 3, wherein the field winding of the stator is concentrically arranged with the rotor and the rotor has a circumference around which the permanent magnets are arranged.

10. The device according to claim 1, further including a bearing on which the rotor is rotatably supported in the trough and a liquid adhesive contained in the trough, the liquid adhesive including a lubricant for the bearing.

* * * * *